United States Patent [19]

Clomburg, Jr.

[11] Patent Number: 4,736,693

[45] Date of Patent: Apr. 12, 1988

[54] PARTIAL COMBUSTION BURNER WITH HEAT PIPE-COOLED FACE

[75] Inventor: Lloyd A. Clomburg, Jr., Houston, Tex.

[73] Assignee: Shell Oil Company, Houston, Tex.

[21] Appl. No.: 80,124

[22] Filed: Jul. 31, 1987

[51] Int. Cl.[4] ..... F23D 1/00

[52] U.S. Cl. ..... 110/263; 239/132.3; 431/160

[58] Field of Search ..... 431/160; 239/132.3; 110/363, 364; 122/6.5, 6.6

[56] References Cited

U.S. PATENT DOCUMENTS

| | | | |
|---|---|---|---|
| 3,592,577 | 7/1971 | Kofink | 431/350 |
| 3,644,076 | 2/1972 | Bagge | 239/132.3 X |
| 3,854,454 | 12/1974 | Lazardis | 122/33 |
| 3,937,017 | 2/1976 | Beschorner et al. | 60/516 |
| 4,437,415 | 3/1984 | Spielman | 431/160 X |
| 4,525,175 | 6/1985 | Stellaccio | 239/132.3 |
| 4,666,397 | 5/1987 | Wenning et al. | 431/160 |

*Primary Examiner*—Edward G. Favors

[57] ABSTRACT

Disclosed is a burner for the partial combustion of a carbonaceous fuel, wherein e.g. coal and oxygen are supplied to a reactor space and heat from the combustion is transferred from the burner face by means of a heat pipe to a fluid cooled section of the burner.

8 Claims, 2 Drawing Sheets

PARTIAL COMBUSTION BURNER WITH HEAT PIPE-COOLED FACE

BACKGROUND OF THE INVENTION

The invention relates to a burner for use in the partial combustion of carbonaceous fuels, and particularly for the partial combustion of finely divided solid fuel, such as pulverized coal, in which the fuel is introduced together with an oxygen-containing gas and, optionally, a temperature moderator gas, into a reactor space.

Partial combustion, also known as gasification, of a fluid or solid carbonaceous fuel is obtained by the reaction of the fuel with oxygen. The fuel contains as useful components mainly carbon and hydrogen, which react with the supplied oxygen- and possibly with steam and carbon dioxide to form carbon monoxide and hydrogen. Depending on the temperature, the formation of methane is also possible. While the invention is described primarily with reference to pulverized coal, the burner according to the invention is also suitable for other carbonaceous fluid or finely divided solid fuels which can be partially combusted, such as gaseous or liquid hydrocarbons, lignite, pulverized wood, bitumen, soot and petroleum coke. In the gasification process the oxygen-containing gas may be pure oxygen or a gas containing molecular oxygen such as air; a mixture of air and oxygen can be used.

There are in principle two different processes for the partial combustion of e.g. solid fuel. In the first process, solid fuel in particulate form is contacted with an oxygen-containing gas in a reactor in a fixed or fluidized bed at a temperature below about 1000° C. A draw back of this method is that not all types of solid fuel can be partially combusted in this manner. For example, high swelling coal is unsuitable since particles of such coal type easily sinter with the risk of clogging of the reactor.

A more advantageous process passes the fluid or finely divided fuel into a reactor at relatively high velocity. In the reactor a flame is maintained in which the fuel reacts with oxygen-containing gas at temperatures above 1000° C. The carbonaceous fuel is usually passed directly or in a carrier fluid to the reactor via a burner, while the oxygen-containing gas is also passed via the burner to the reactor. In some processes a moderator gas such as steam or carbon dioxide is also passed via the burner to the reactor; such moderator gas is often advantageous for preventing premature contact of oxygen with the reactor gas, which might result in undesirable complete conversion of the reactor gas. A number of carbonaceous fuel burner designs are known, including U.S. Pat. No. 3,847,564; U.S. Pat. No. 3,945,942; U.S. Pat. No. 4,350,103; U.S. Pat. No. 4,351,647; U.S. Pat. No. 4,443,228; U.S. Pat. No. 4,458,607; U.S. Pat. No. 4,510,874; U.S. Pat. No. 4,519,321; and U.S. Pat. No. 4,523,529, all incorporated by reference.

A primary concern of such burners is to prevent damage to the burner front, also referred to as the burner face, caused by the heat load during the gasification process. To protect the burner front from overheating it is conventional to provide a refractory lining applied to the outer surface of the burner front wall for resisting the heat load during operation of the burner and/or provide the burner front a hollow wall member with internal cooling passages through which cooling fluid is circulated at a rapid rate. A drawback of the latter approach is that fabrication is difficult because very substantial amounts of heat must be transferred from the front face to the cooling fluid in a small volume with limited accessability.

SUMMARY OF THE INVENTION

An object of the invention is to provide a burner for the partial combustion of carbonaceous fuel with oxygen wherein the face of the burner is cooled by means of a heat pipe that transfers heat rapidly and efficiently from the burner front face to a fluid cooled section spaced apart from the burner face.

A further object of the invention is to provide a burner that would allow cooling to occur with area multiplication in a volume space removed from the front face.

In order to meet the above objectives the invention provides an improved burner for the partial combustion of carbonaceous fuel having a front face, said face containing at least one outlet for each of (1) the carbonaceous fuel, and (2) oxygen-containing gas, and having associated means for cooling said burner face with a cooling fluid, the improvement comprising having a heat pipe disposed between said burner face and said cooling means for transfering heat from said face to said cooling means.

In a suitable embodiment of the invention, a burner for the partial combustion of finely divided solid fuel comprises:

a front face disposed normal to the longitudinal axis of the burner, said front face having: (1) at least one central outlet for the finely divided fuel; and (2) at least one central outlet for the oxygen-containing gas;

heat pipe means disposed upstream along the longitudinal axis of said burner in direct heat transfer relation with said burner face for removing heat load from said front face during operation of said burner, and cooling means disposed upstream from said heat pipe along the longitudinal axis of said burner in direct heat transfer relation with said heat pipe means for removing heat from said heat pipe during operation of said burner.

In a particular embodiment of the invention a burner for the partial combustion of finely divided solid fuel comprises:

a burner face having a central outlet for a first reactant stream;

a substantially annular outlet in said burner face substantially concentrically surrounding said central outlet, for a second reactant stream;

means for removing the heat load of the burner, said means for removing being disposed proximate to the front face of said burner for direct heat removal from said front face, and comprising a hollow cylinder having at least the interior thereof of a material having a capillary action, and a liquid in said means capable of evaporating when subjected to heat, to be drawn by capillary action; and means for cooling, spaced apart from said burner face and disposed in heat transfer relation with said means for removing the heat load, for cooling said means for removing.

In a suitable embodiment of the invention the total cross sectional area of the means for removing (heat pipe) in heat transfer relation with said cooling means is at least 1.2 times the cross sectional area of the heat pipe in heat transfer relation to the front face of the burner.

BRIEF DESCRIPTION OF THE DRAWINGS

The invention will now be described in more detail by way of example only with reference to the accompanying drawings, wherein.

DESCRIPTION OF THE PREFERRED EMBODIMENTS

Figure 1:
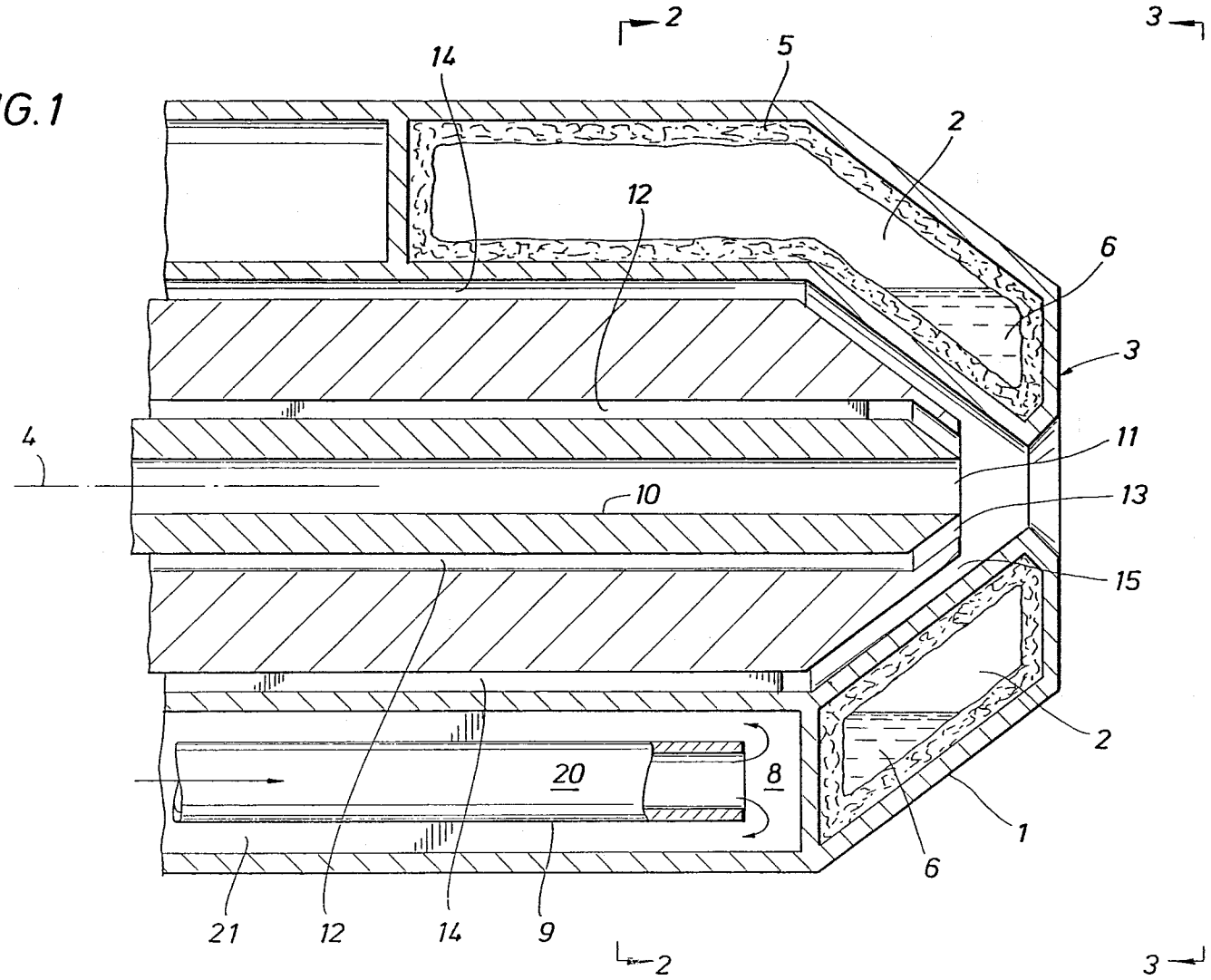
FIG. 1 shows a longitudinal section of the front part of a burner according to the invention corresponding to 1-1 of FIG. 2.

It should be noted that identical elements shown in the drawings have been indicated with the same reference numeral.

Figure 2:
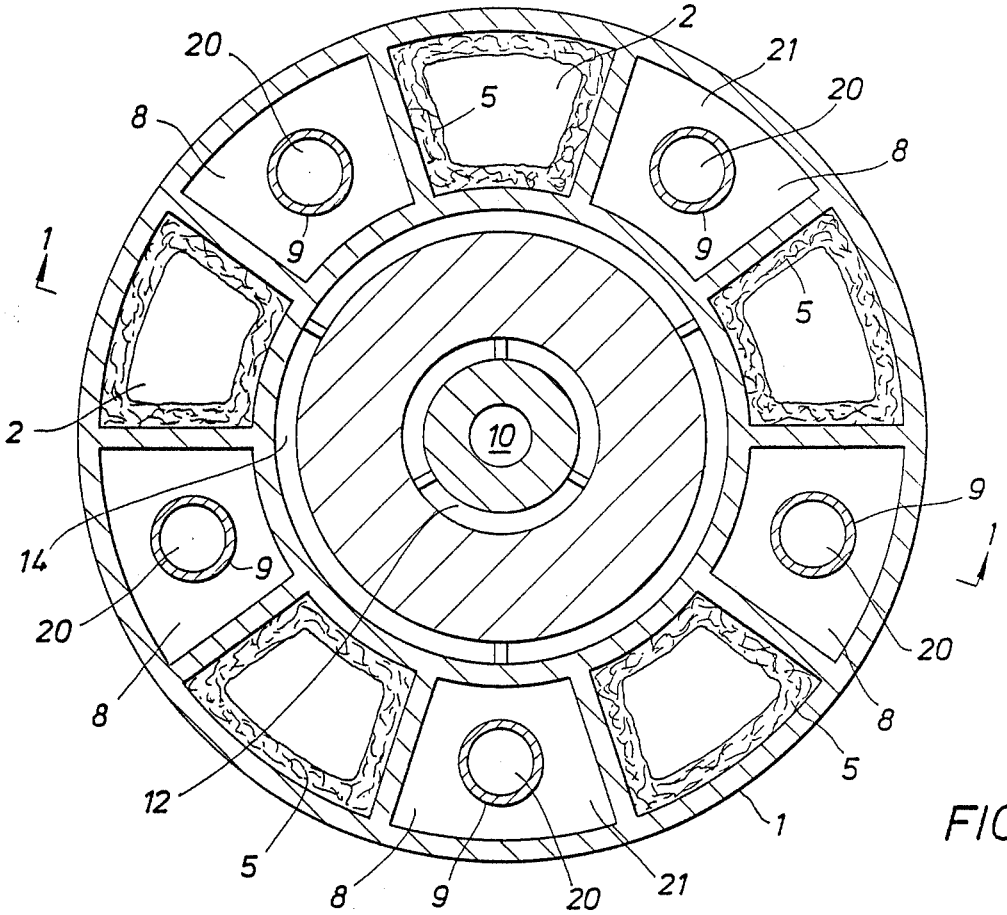
FIG. 2 shows a cross-section of 2-2 of FIG. 1.
Figure 3:
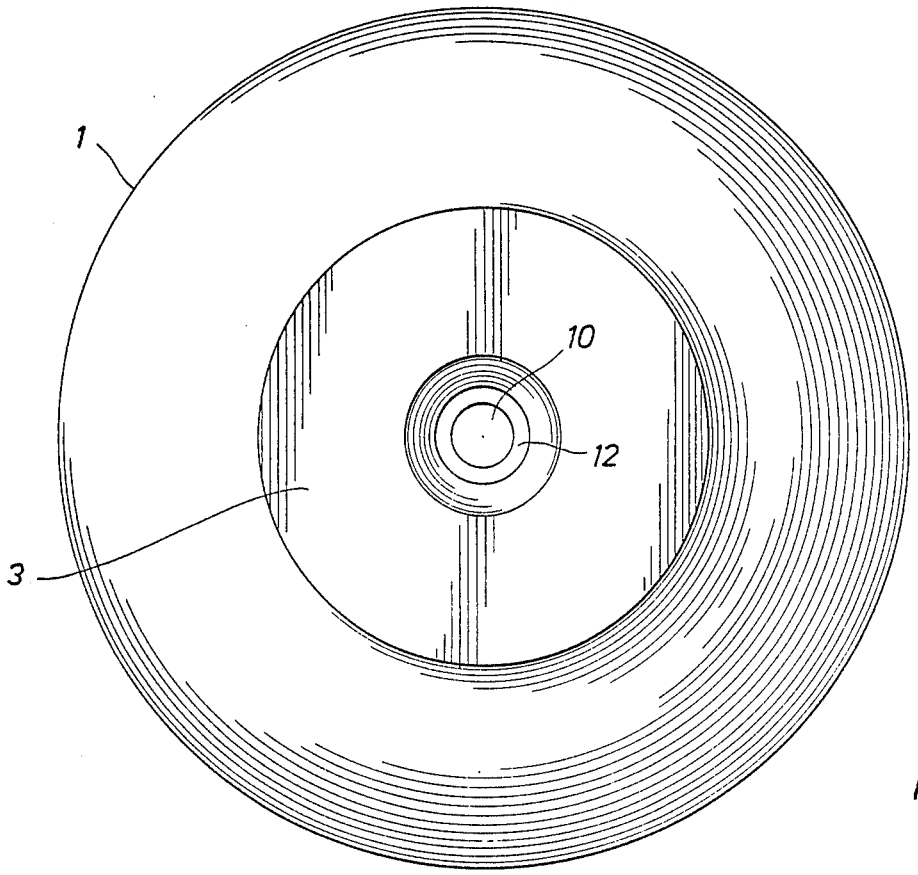
FIG. 3 shows a view from 3-3 of FIG. 1.

Referring to FIGS. 1 and 2, a burner, generally indicated with the reference numeral 1, for the partial combustion of a carbonaceous fuel, such as pulverized coal, comprises a cylindrical heat pipe member 2 having an enlarged end part forming a front face 3 which is normal to the longitudinal axis 4 of the burner. The heat pipe member 2 encompasses a first central channel 10 for a first reactant stream which may be either carbonaceous fuel or oxygen-containing gas, as desired, said channel 10 being in communication with an annular outlet 11, and a second central channel 12 having a free end forming an outlet 13 for a second reactant stream which may be either carbonaceous fuel or oxygen-containing gas, but will be dissimilar from said first reactant stream. The first central channel 10 and the second central channel 12 are axially spaced apart from one another, and are concentrically arranged with respect to one another.

The heat pipe member 2 is a hollow cylinder having a downstream end at the burner face 3 and means for capillary action such as radial grooves (not shown) or a layer of wicking material 5 such as woven wire mesh covering the inside surface with a hollow core in the center. A condensible working liquid 6 such as water or hexadecane is also contained in the pipe, and the liquid permeates the aforesaid wicking material by capillary action.

As is known in the art when heat is applied to one end of the heat pipe, herein at the burner face, the liquid in the wick is vaporized and moves to the central core; when heat is removed, herein by cooling means, the vapor is condensed back into the wick, and the condensed liquid returns to the heated end of the heat pipe by capillary action. The heat pipe effects transfer of substantial quantities of heat through small surface areas.

The heat pipe at the upstream end, is in heat transfer relation with cooling means 8 such as a fluid cooled channel and which may be a portion of the burner body cored to provide an annular passage 21 for circulating a cooling fluid such as water, which enters via passage 20 in conduit 9. Preferably the upstream end of the heat pipe extends longitudinally in the body of the burner as a plurality of fingers in close proximity with a plurality of complementary cooling passages therebetween. The number of fingers is not critical and may vary from two to twelve or more, as desired.

Preferably the total cross sectional area of the heat pipe in heat transfer relation with said cooling means is at least 1.2, and more preferably at least about 1.5 times the cross sectional area of the heat pipe in heat transfer relation to the front face of the burner. In this manner the heat at the burner face is efficiently transferred to the larger area for cooling.

FIG. 1 further shows optional central channel 14 for a moderating gas such as steam or carbon dioxide, said channel 14 being in communication with annular outlet 15. This optional channel will be axially spaced apart from each of the first central channel 10 and the second central channel 12 and axially spaced apart from each of said first and second central channels.

FIG. 2 shows the downstream portion of the heat pipe ending in a plurality of fingers, which fingers are in heat transfer relation with a plurality of channels 8 for cooling fluid, each said channel being interiorly provided with a conduit 9 to divide the channels into passages 20 and 21 for cooling fluid supplied to and discharged from the interior of channels via not shown conduit means.

During operation of the above described burner 1 for the gasification of carbonaceous fuel, e.g. pulverized coal by means of oxygen-containing gas, said coal suspended in a carrier fluid such as air or nitrogen is passed through the central channel 10 to outlet 11 for introducing the coal into a reactor space arranged downstream of the burner.

Simultaneously, oxygen-containing gas is passed through the annular channel 12 to outlet 13 so that the coal and oxygen containing gas reactants will be intensively mixed in the reactor space. The mixing of the reactants can be further promoted by a swirling motion imparted to one or both streams by a swirl body or baffles (not shown) in the appopriate channel. To promote stable outflow of coal the cross sectional area available for the coal flow should be kept constant over at least part of the burner near the outlet.

During operation of the burner for gasification of pulverized coal, a temperature moderator gas when used, such as for example steam or carbon dioxide, conveyed through annular channel 14 forms a shield around the issuing coal and oxygen jets. The shield of moderator gas may be advantageous for preventing premature contact of oxygen with the reactor gas, which might result in undesirable complete conversion of the reactor gas.

It should be noted that the present invention is not restricted to a burner having a single outlet for each of the solid fuel and oxygen-containing reactants. Instead of a single annular outlet for each reactant, a plurality of outlets for one or both reactants may be applied, and a plurality of outlets for the optional temperature moderating gas as well, provided that heat is directly removed from the burner face directly by a heat pipe.

The burner will ordinarily be constructed of high temperature resistant materials, particularly high temperature resistant metals and alloys such as Inconel and/or ceramics. For high duty operations the channels and outlets for oxygen-containing gas which are usually made of metal are preferably internally coated with an oxydic coating, such as $ZrO_2$, or a ceramic, enabling the application of high oxygen-containing gas velocities without the risk of metal combustion by the oxygen.

In a preferred embodiment the burner front face will in addition be provided with a suitable refractory lining for better resisting the heat load during operation of the burner.

What is claimed is:

1. In a burner for the partial combustion of carbonaceous fuel having a front face, said face having at least one outlet for each of (1) the carbonaceous fuel, and (2)

oxygen-containing gas, and having associated means for cooling said burner face with a cooling fluid, the improvement which comprises having a heat pipe intermediate between said burner face and said cooling means for transferring heat from said face to said cooling means.

2. In a burner for the partial combustion of finely divided solid fuel having a front face, said face having at least one outlet for each of (1) the finely divided solid fuel, and (2) oxygen-containing gas, and having associated means for cooling said burner face with a cooling fluid, the improvement which comprises having a heat pipe intermediate between said burner face and said cooling means for transfering heat from said face to said cooling means.

3. A burner as in claim 1 wherein said burner face contains in addition at least one outlet for a moderating fluid.

4. A burner for the partial combustion of carbonaceous fuel comprising:

a front face disposed normal to the longitudinal axis of the burner, said front face having: (1) at least one central outlet for a first reactant stream which may be carbonaceous fuel or oxygen-containing gas; and (2) at least one substantially annular outlet substantially surrounding said central outlet, for a second reactant stream which may be either carbonaceous fuel or oxygen-containing gas, but will be dissimilar from said first reactant stream;

heat pipe means disposed upstream along the longitudinal axis of said burner in direct heat transfer relation with said burner face for removing heat load from said front face during operation of said burner, and cooling means disposed upstream from said heat pipe means along the longitudinal axis of said burner in direct heat transfer relation with said heat pipe means for removing heat from said heat pipe during operation of said burner.

5. A burner as recited in claim 4 wherein the total cross sectional area of said heat pipe means in heat transfer relation with said cooling means is at least 1.2 times the cross sectional area of said heat pipe means in heat transfer relation with the front face of the burner.

6. A burner for the partial combustion of finely divided solid fuel comprising:

a central outlet for the finely divided fuel;

a substantially annular outlet substantially concentrically surrounding said central outlet, for oxygen-containing gas;

means for removing the heat load of the burner, said means for removing being disposed proximate to the front face of said burner for direct heat removal from said front face, and comprising a hollow metallic cylinder having at least the interior surface thereof of a material having a capillary action, and a working liquid in said means capable of evaporating when subjected to heat to be drawn by capillary action; and means for cooling, spaced apart from said burner face and disposed in heat transfer relation with said means for removing the heat load, for cooling said means for removing.

7. A burner as recited in claim 1, wherein said means for cooling comprises a a hollow wall member with internal cooling fluid passages.

8. A burner as recited in claim 6, wherein in the total cross sectional area of the means for removing the heat load of the burner which is in heat transfer relation with said means for cooling is at least 1.2 times the cross sectional area of said means for removing the heat load of the burner in heat transfer relation to the front face of the burner.

* * * * *